US009800004B1

(12) United States Patent
Schepis et al.

(10) Patent No.: US 9,800,004 B1
(45) Date of Patent: Oct. 24, 2017

(54) BUSBAR CONNECTOR ASSEMBLY

(71) Applicant: Amphenol Corporation, Wallingford, CT (US)

(72) Inventors: Randy Schepis, Endwell, NY (US); Lonnie L. Fisher, Hallstead, PA (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 15/146,225

(22) Filed: May 4, 2016

(51) Int. Cl.
*H01R 25/16* (2006.01)
*H01R 43/20* (2006.01)
*H01R 4/30* (2006.01)

(52) U.S. Cl.
CPC ..... *H01R 25/162* (2013.01); *H01R 4/305* (2013.01); *H01R 43/20* (2013.01)

(58) Field of Classification Search
CPC .... H01R 25/16; H01R 25/162; H01R 25/164; H01R 25/14; H01R 25/145
USPC ..... 439/213, 215, 65, 251, 857
See application file for complete search history.

(56) References Cited

U.S. PATENT DOCUMENTS 3,180,924 A * 4/1965 Rowe ..... H02G 5/007 174/88 B
3,723,940 A * 3/1973 Leonard ..... H01H 1/42 439/251
3,733,575 A 5/1973 Gottschalk et al.
4,423,917 A * 1/1984 Scheingold ..... H01R 13/6315 439/249
4,462,657 A 7/1984 Snowdon et al.
4,878,862 A 11/1989 Wise
4,981,449 A 1/1991 Buchter
4,983,132 A * 1/1991 Weidler ..... H01R 25/162 439/251
4,995,814 A * 2/1991 Weidler ..... H01R 25/162 439/513
5,421,751 A * 6/1995 Bennett ..... H01R 13/187 439/786

(Continued)

FOREIGN PATENT DOCUMENTS

CN 202564673 U * 11/2012
DE EP 2237383 A2 * 10/2010 ..... H02B 1/20

OTHER PUBLICATIONS

EP2237383_translation.*
CN202564673_translation.*

*Primary Examiner* — Tulsidas C Patel
*Assistant Examiner* — Marcus Harcum
(74) *Attorney, Agent, or Firm* — Blank Rome LLP

(57) ABSTRACT

A busbar connector assembly that includes a housing having two portions facing one another that each have an attachment section and a guide section. A first receiving area of the housing receives a first busbar. A second receiving area of the housing receives a second busbar. First and second contact members are coupled to the housing portions. The first and second contact members each have a fixed end and a flexible end having a busbar contact surface. The housing has first and second open ends leading into the receiving areas. The first open end has a continuous width. The second open end includes lead-in surfaces formed in the housing guide sections. The lead-in surfaces define a largest width of the second open end converging to a smallest width thereof. The smallest width of the second open end is substantially the same as the width of the first open end.

19 Claims, 2 Drawing Sheets

(56) References Cited

U.S. PATENT DOCUMENTS

| | | | | |
|---|---|---|---|---|
| 7,704,083 | B1 * | 4/2010 | Cheyne | H01R 25/162<br>439/115 |
| 7,845,985 | B2 * | 12/2010 | Brunker | H01R 13/504<br>439/631 |
| 8,911,248 | B1 * | 12/2014 | Wildstone | H01R 4/60<br>307/65 |
| 8,998,618 | B2 * | 4/2015 | Hashiguchi | H01R 13/113<br>439/12 |
| 9,006,571 | B2 * | 4/2015 | Manhart | H02B 1/21<br>174/129 B |

* cited by examiner

BUSBAR CONNECTOR ASSEMBLY

FIELD OF THE INVENTION

The present application relates to a connector assembly for mating busbars. The connector assembly allows connection of two busbars that can be easily mated and unmated.

BACKGROUND OF THE INVENTION

Busbars are typically strips of metals, such as cooper or aluminum, for conducting power. The busbars can vary in thickness for different power requirements. Often busbars from different electrical systems need to be connected to transfer power between the two systems. A common approach is to fasten the busbars together using a connector or using a sliding connector that pushes on the adjoining busbars from the sides thereof or joining the busbars by bolts. Such conventional connectors, however, can only be used with one type or thickness of busbar. Thus if a busbar of a different type or thickness is needed in the field, a different connector must first be assembled to that busbar before it is usable in the field.

Therefore, a need exists for a busbar connector assembly that may be used with any type or thickness of busbar such that the connector is field installable and that is cost efficient to manufacture.

SUMMARY OF THE INVENTION

Accordingly, an exemplary embodiment of the present invention provides a busbar connector assembly includes a housing that has first and second housing portions facing one another, where each of the first and second housing portions has opposite inner and outer surfaces and two sections including an attachment section and a guide section. A first receiving area is defined between the inner surfaces of the first and second housing portions at the attachment sections thereof. The first receiving area is configured to receive a first busbar. A second receiving area is defined between the inner surfaces of the first and second housing portions at the guide sections thereof. The second receiving area is configured to receive a second busbar. A first contact member is coupled to the inner surface of the first housing portion at the attachment section thereof. The first contact member has a fixed end attached to the attachment section of the first housing portion and a flexible end that has a busbar contact surface. A second contact member is coupled to the inner surface of the second housing portion at the attachment section thereof. The second contact member has a fixed end attached to the attachment section of the second housing portion and a flexible end that has a busbar contact surface. The housing has first and second open ends that lead into the first and second receiving areas, respectively. The first open end has a substantially continuous width between the attachment sections of the first and second housing portions. The second open end includes first and second lead-in surfaces formed in the guide sections of the first and second housing portions, respectively. The first and second lead-in surfaces define a largest width of said second open end converging to a smallest width of said second open end. The smallest width of the second open end is preferably substantially the same as the width of the first open end.

The present invention also provides a busbar connector assembly that includes a housing that has first and second housing portions facing one another. Each of the first and second housing portions has opposite inner and outer surfaces and two sections that includes an attachment section and a guide section. A first receiving area is defined between the inner surfaces of the first and second housing portions at the attachment sections thereof. The first receiving area receives a first busbar that has a first thickness. A second receiving area is defined between the inner surfaces of the first and second housing portions at the guide sections thereof. The second receiving area receives a second busbar that has a second thickness. The second thickness of the second busbar is substantially the same as the first thickness of the first bus bar. A first contact member is coupled to the inner surface of the first housing portion at the attachment section thereof. The first contact member has a fixed end attached to the attachment section of the first housing portion and a flexible end that has a busbar contact surface. A second contact member is coupled to the inner surface of the second housing portion at the attachment section thereof. The second contact member has a fixed end attached to the attachment section of the second housing portion and a flexible end that has a busbar contact surface. The first busbar is fixed between the fixed ends of the first and second contact members and the second busbar is slidably received between the flexible ends of the first and second contact members such that the busbar contact surfaces of the flexible ends are in physical and electrical contact with surfaces of the second busbar.

The present invention may further provide the method of assembling a busbar connector assembly that includes the steps of providing a housing that has first and second housing portions that face one another, each of the first and second housing portions having opposite inner and outer surfaces and two sections including an attachment section and a guide section; providing a first contact member coupled to the inner surface of the first housing portion at the attachment section thereof, the first contact member has a fixed end attached to the attachment section of the first housing portion and a flexible end has a busbar contact surface; providing a second contact member coupled to the inner surface of the second housing portion at the attachment section thereof, the second contact member has a fixed end attached to the attachment section of the housing portion and a flexible end has a busbar contact surface; locating an end of a first bus bar in a first receiving area that is defined between the first and second housing portions at the attachment sections thereof and between the fixed ends of the first and second contact members, such that the first busbar is fixed in the first receiving area; inserting an insertion end of a second busbar into a second receiving area that is defined between the first and second housing portions at the guide sections thereof and between the flexible ends of the first and second contact members, such that the second busbar is slidably and releasably received in the second receiving area, wherein in the busbar contact surfaces of the flexible ends are in contact with surfaces of the second busbar to electrically couple the first and second busbars.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
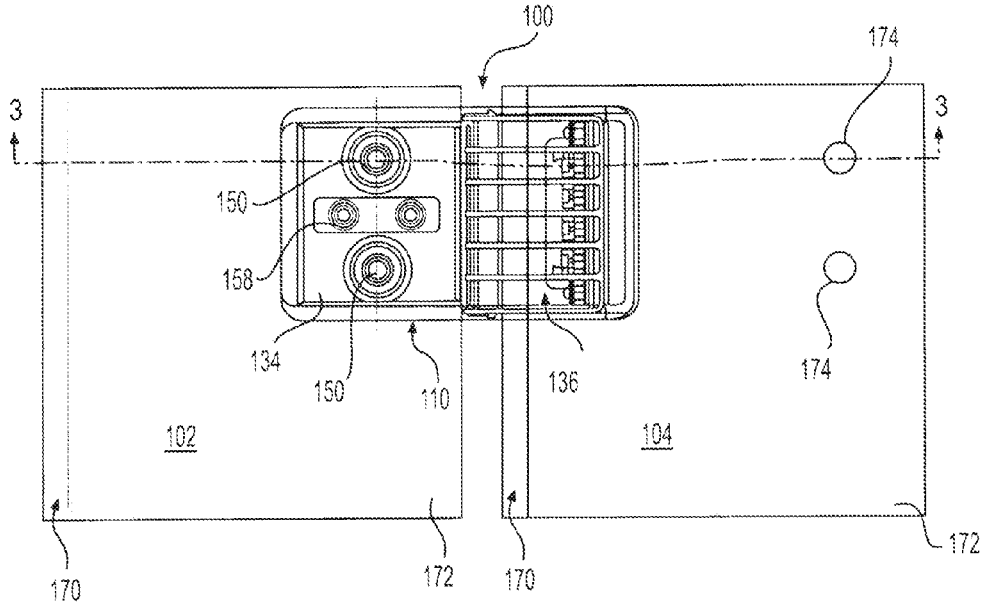
FIG. 1 is top plan view of a busbar connector assembly in accordance with an exemplary embodiment of the present invention, showing the busbar connector assembly mating two busbars.
Figure 2:
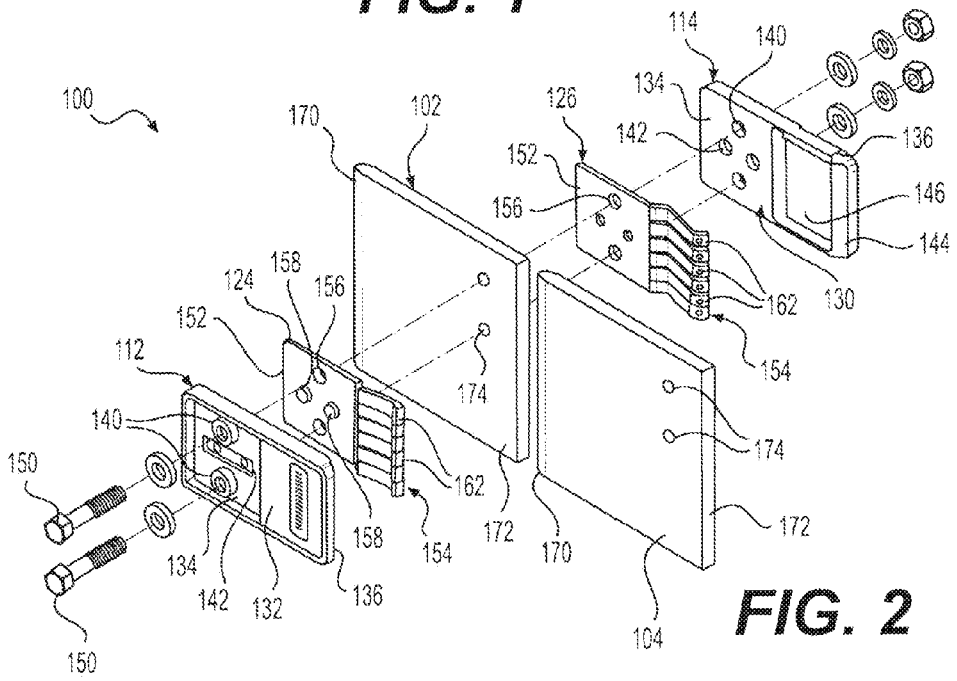
FIG. 2 is an exploded view of the busbar connector assembly illustrated in FIG. 1.

Referring to FIGS. 1-4, the present invention generally relates to a busbar connector assembly 100 for electrically and mechanically connecting a plurality of busbars, such as first and second busbars 102 and 104. The busbar connector assembly 100 is designed to be used with any type or thickness of busbars, therefore allowing the busbar connector assembly 100 to be field installed rather than requiring a different connector for each type or thickness of busbar before installation. The busbar connector assembly 100 is structured to allow easy mating and unmating of the busbars 102 and 104. In general, the busbar connector assembly 100 includes a housing 110 with first and second housing portions 112 and 114 facing one another, first and second receiving areas 116 and 118 that receive busbars through first and second open ends 120 and 122 of the housing 110, and first and second contacts 124 and 126 disposed in the first and second receiving areas 116 and 118, respectively, for contacting busbars. In a preferred embodiment, the housing open ends 120 and 122 and the receiving areas 116 and 118 are sized to receive busbars that have substantially the same thickness. Because many of the components of the busbar connector assembly 100 are substantially identical, manufacturing costs are reduced.

Housing portion 112 and 114 are substantially identical and each generally includes opposite inner and outer surfaces 130 and 132, and two sections including an attachment section 134 and a guide section 136. The housing portions 112 and 114 are preferably made of diecast metal but may be made of any rigid material, such as plastic. A perimeter of each housing portion 112 and 114 may include an outwardly extending flange 138 such that the outer surface 132 is recessed. The attachment sections 134 are configured to attach to the first busbar 102 and the guide sections 136 are configured to guide the second bus bar 104 into the second receiving area 118 of the housing 110. The facing of the first and second housing portions 112 and 114 forms the first and second receiving areas 116 and 118. First receiving area 116 is defined between the inner surfaces 130 of the housing portions 112 and 114 at the attachment sections 134 thereof and second receiving area 118 is defined between the inner surfaces 130 of the housing portions 112 and 114 at the guide sections 136 thereof.

Each attachment section 134 includes a fastening member, such as one or more through holes 140 for receiving a fastener 150, such as a screw. In a preferred embodiment, each attachment section 134 includes two through holes 140 spaced from one another such that each holes 140 is proximate a side edge of the housing portion. Each attachment section 134 further includes a contact alignment component, such as one or more holes 142, adapted to receive a corresponding alignment component of the first and second contact members 124 and 126, respectively, for properly aligning the first and second contact members 124 and 126 with the attachments sections 134 of the first and second housing portions 112 and 114, respectively. In a preferred embodiment, two holes 142 are located in the space between the fastener through holes 140, such that the through holes 140 and the holes 142 may be disposed in a cross arrangement. While the outer surface 132 at the attachment section 134 is recessed due to flange 138, the inner surface 130 is substantially flat.

Figure 3:
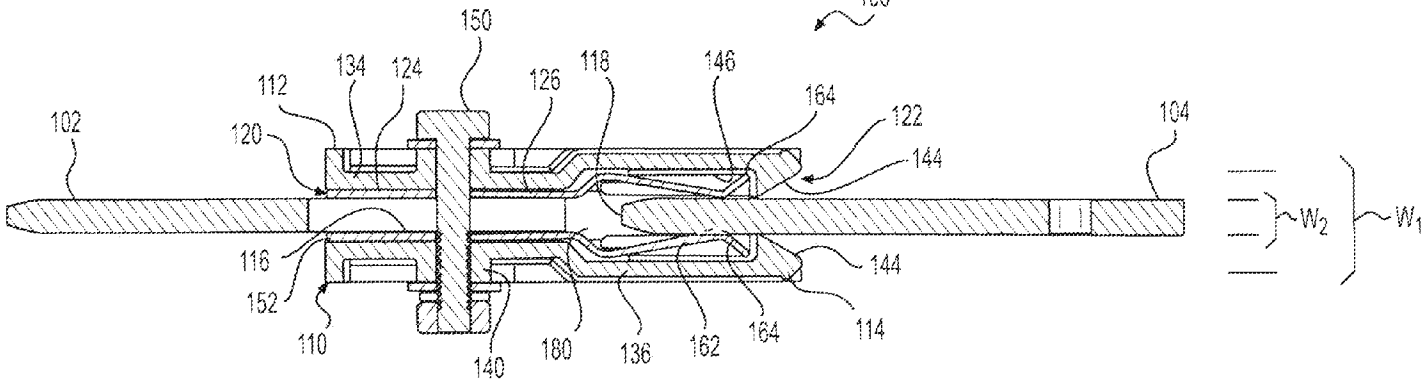
FIG. 3 is a cross-sectional view of the busbar connector assembly illustrated in FIG. 1 taken along line 3-3 of FIG. 1.

Each guide section 136 includes a lead-in surface 144 at the second open end 122 of the housing 110, as best seen in FIG. 3. The lead-in surfaces 144 taper inwardly from a largest width $W_1$ of second open end 122 to a smallest width $W_2$ of the second open end 122 to guide the busbar 102 into the housing's second receiving area 118. Each guide section 136 further includes a recessed area 146 at the inner surface 130 for receiving a portion of one of the first and second contact members 124 and 126. The first open end 120 preferably has a substantially continuous width that is substantially the same as the smallest width $W_2$ of the second open end 122. As such, the first and second open ends 120 and 122 are sized to receive busbars 102 and 104 that have substantially the same thickness.

Figure 4:
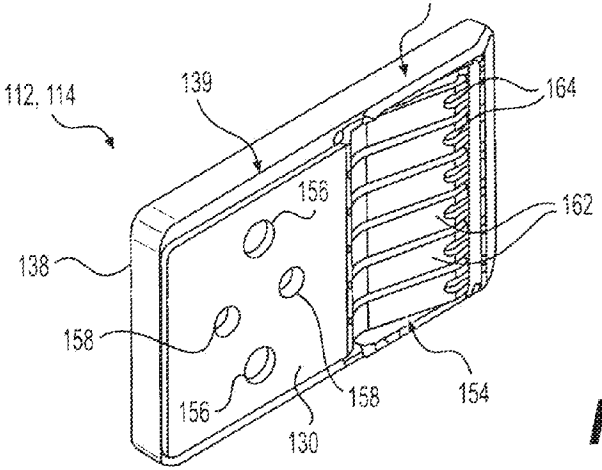
FIG. 4 is a perspective view of a housing portion subassembly of the busbar connector assembly illustrated in FIG. 1.

The first and second contact members 124 and 126 are substantially identical and each generally includes a fixed end 152 and a flexible end 154. The contacts members 124 and 126 are preferably made of copper alloy. Each fixed end 152 is preferably substantially flat plate and adapted to couple to the attachment sections 134 of the first and second housing portions 112 and 114, respectively, at the inner surface 130 thereof. Each fixed end includes one or more fastener through holes 156 corresponding to the housing through holes 140 for receiving the fastener 150. Each fixed end 152 further includes an alignment component, such as one or more detents 158, that may be inserted into the alignment holes 142 of the housing portions' attachment sections 134 for properly aligning the contact members 124 and 126 with the housing portions 112 and 114, respectively. Each flexible end 154 of the contact members 124 and 126 includes a busbar contact surface 160 for contacting surface of the second busbar 102. Each flexible end 154 preferably includes one or more flexible fingers 162. Each flexible finger 162 may include an outwardly flared distal end 164 forming a v-shaped portion of the finger wherein the busbar contact surface 160 is at the v-shaped portion adjacent the flared distal end 164, as best seen in FIGS. 3 and 4. Each flexible end 154 and its fingers 162 are accommodated in the recessed area 146 of the housing portions wherein the recesses area 146 is sized to allow the fingers 162 to flex outwardly when the second busbar 104 is inserted into the housing's second receiving area 118.

The busbars 102 and 104 are preferably substantially identical with substantially the same thickness. The busbars 102 and 104 preferably have a high amperage capacity, for example, 1000 to 1500 amps. Each busbar 102 and 104 has an insertion end 170 and an opposite attachment end 172. The insertion end 170 of each busbar 102 and 104 is preferably chamfered to facilitate insertion of the busbar into the housing 110, and specifically the second receiving area 118 of the housing 110. Near the attachment end 172 of each busbar 102 and 140 is one or more fastener holes 174 that correspond to the fastener through holes 140 of the housing portions 112 and 114 for receiving the one or more fasteners 150. The fastener holes 174 allows the attachment of the busbar connector assembly 100 on one or both of the busbars 102 and 104.

The busbar connector assembly 100 of the present invention may be assembled by locating the attachment end 172 of the first bus bar 102 in the housing's first receiving area 116 between the housing portions 112 and 114 at the attachment sections 134 thereof and between the fixed ends 152 of the contact members 124 and 126, such that the first busbar 102 is sandwiched therebetween and fixed in the first receiving area 116. Next the insertion end 170 of the second busbar 104 is inserted into the second receiving area 118 that is defined between the housing portions 112 and 114 at the guide sections 134 thereof and between the flexible ends 154 of the contact members 124 and 126, such that the second busbar is slidably and releasably received in the second receiving area. When the insertion end 170 of the second busbar 104 is received in the second receiving area 118, the busbar contact surfaces 164 of the contact members' flexible ends 154 flex slightly outwardly such that they are in contact with and biased against outer surfaces of the second busbar 104 to electrically couple the first and second busbars 102 and 104. In a preferred embodiment, a space 180 (FIG. 3) is provided between the ends of the first and second busbars 102 and 104 such that the busbars 102 and 104 are not in physical contact when the second busbar 104 is received in the housings' second receiving area 118. Because the second busbar 104 also includes fastener holes 174, a second busbar connector assembly 100 of the present invention may be attached to the second busbar 104 allowing a third busbar to be coupled thereto for electrical connection between the second and third busbars. Thus the busbar connector assembly 100 of the present invention allows a series of busbar to be electrically connected to one another.

While particular embodiments have been chosen to illustrate the invention, it will be understood by those skilled in the art that various changes and modifications can be made therein without departing from the scope of the invention as defined in the appended claims. For example, the connector assembly 100 is scalable to any desired current capacity, that is, the components of the connector assembly 100 may be made wider or narrow to increase or decrease the connector's current capacity.

What is claimed is:

1. A busbar connector assembly, comprising:

a housing having first and second housing portions facing one another, each of said first and second housing portions having opposite inner and outer surfaces and two sections including an attachment section and a guide section;

a first receiving area is defined between said inner surfaces of said first and second housing portions at said attachment sections thereof, said first receiving area being configured to receive a first busbar;

a second receiving area is defined between said inner surfaces of said first and second housing portions at said guide sections thereof, said second receiving area being configured to receive a second busbar;

a first contact member coupled to said inner surface of said first housing portion at said attachment section thereof, said first contact member having a fixed end attached to said attachment section of said first housing portion and a flexible end having a busbar contact surface;

a second contact member coupled to said inner surface of said second housing portion at said attachment section thereof, said second contact member having a fixed end attached to said attachment section of said second housing portion and a flexible end having a busbar contact surface; and at least one fastener extending through said attachments sections of said first and second housing portions, through said first receiving area, and through said fixed ends of said first and second contact members, wherein said housing has first and second open ends that lead into said first and second receiving areas, respectively, said first open end having a substantially continuous width between said attachment sections of said first and second housing portions, said second open end including first and second lead-in surfaces formed in said guide sections of said first and second housing portions, respectively, and said first and second lead-in surfaces defining a largest width of said second open end converging to a smallest width of said second open end, wherein said smallest width of said second open end is substantially the same as said width of said first open end.

2. A busbar connector assembly according to claim 1, wherein said fastener is a screw that has a head located adjacent said outer surface of said first housing portion; and said fastener extends into a through hole located ii each of said attachment sections of said first and second housing portions and each of said fixed ends of said first and second contact members.

3. A busbar connector assembly according to claim 1, wherein each said inner surface of each of said guide sections of said first and second housing portions includes a recessed area for accommodating said flexible ends of said first and second contact members, respectively.

4. A busbar connector assembly according to claim 1, wherein each of said fixed ends of said first and second contact members is substantially flat plate; and each of said flexible ends of said first and second contact members includes one or more flexible fingers.

5. A busbar connector assembly according to claim 4, wherein each of said one or more flexible fingers includes an outwardly flared distal end; and each of said busbar contact surfaces is located adjacent said outwardly flared distal end, respectively.

6. A busbar connector assembly according to claim 1, wherein each attachment section of said first and second housing portions including at least one contact alignment component; and each fixed end of said first and second contact members includes at least one alignment component corresponding to said contact alignment components of said first and second housing portions, respectively, said alignment components of said first and second contact members engaging said contact alignment components of said first and second housing portions, respectively, thereby locating said first and second contacts members with respect to said first and second housing portions, respectively.

7. A busbar connector assembly according to claim 6, wherein each of said contact alignment components of said first and second housing portions is a hole; and each of said alignment components of said first and second contact members is a detent, each of said detents is receiving in one of said holes.

8. A busbar connector assembly according to claim 1, wherein each attached section of each of said first and second housing portions includes at least one through hole for receiving a fastener and at least one hole for receiving an alignment component of one of said first and second contact members.

9. A busbar connector assembly according to claim 1, wherein each of said first and second contact members has at least one through hole for receiving a fastener and at least one alignment component for engaging a corresponding contact alignment component on one of said first and second housing portions.

10. A busbar connector assembly, comprising:

a housing having first and second housing portions facing one another, each of said first and second housing portions having opposite inner and outer surfaces and two sections including an attachment section and a guide section;

a first receiving area is defined between said inner surfaces of said first and second housing portions at said attachment sections thereof, said first receiving area receiving a first busbar having a first thickness;

a second receiving area is defined between said inner surfaces of said first and second housing portions at said guide sections thereof, said second receiving area receiving a second busbar having a second thickness, said second thickness of said second busbar is substantially the same as said first thickness of said first bus bar;

a first contact member coupled to said inner surface of said first housing portion at said attachment section thereof, said first contact member having a fixed end attached to said attachment section of said first housing portion and a flexible end having a busbar contact surface;

a second contact member coupled to said inner surface of said second housing portion at said attachment section thereof, said second contact member having a fixed end attached to said attachment section of said second housing portion and a flexible end having a busbar contact surface; and at least one fastener extending through said attachments sections of said first and second housing portions, through said fixed ends of said first and second contact members, and through said first busbar, wherein said first busbar is fixed between said fixed ends of said first and second contact members and said second busbar is slidably received between said flexible ends of said first and second contact members such that said busbar contact surfaces of said flexible ends are in physical and electrical contact with surfaces of said second busbar.

11. A busbar connector assembly according to claim 10, wherein said fastener is a screw that has a head located adjacent said outer surface of said first housing portion; and said fastener extends into a through hole located in each of said attachment sections of said first and second housing portions, in each of said fixed ends of said first and second contact members, and in said first bus bar.

12. A busbar connector assembly according to claim 10, wherein each said inner surface of each of said guide sections of said first and second housing portions includes a recessed area for accommodating said flexible ends of said first and second contact members, respectively.

13. A busbar connector assembly according to claim 12, wherein each flexible end includes one or more flexible fingers.

14. A busbar connector assembly according to claim 13, wherein each of said one or more flexible fingers includes an outwardly flared end, and said busbar contact surface of each of said first and second contact members is located adjacent said outwardly flared end.

15. A busbar connector assembly according to claim 10, wherein an insertion end of said second bus bar is received in said second receiving area and spaced from an end of said first bus bar such that there is nothing between said end of said first busbar and second insertion end of said second bus bar.

16. A busbar connector assembly according to claim 15, wherein said insertion end of said second busbar is chamfered.

17. A busbar connector assembly according to claim 16, wherein said second busbar includes at east one through hole for receiving a fastener that is remote from said insertion end.

18. A busbar connector assembly according to claim 17, wherein said first and second busbars are substantially identical.

19. A busbar connector assembly according to claim 18, wherein said first and second housing portions are substantially identical; and said first and second contact members are substantially identical.

* * * * *